United States Patent [19]

Simmonds

[11] 4,167,107

[45] Sep. 11, 1979

[54] ROLLING MILL STAND

[75] Inventor: Edwin Simmonds, Ringwood, England

[73] Assignee: Loewy Robertson Engineering Company Limited, Dorset, England

[21] Appl. No.: 846,792

[22] Filed: Oct. 31, 1977

[30] Foreign Application Priority Data

Nov. 2, 1976 [GB] United Kingdom .....45514/76

[51] Int. Cl.[2] ..... B21B 31/08

[52] U.S. Cl. ..... 72/239

[58] Field of Search ..... 72/237–239

[56] References Cited

U.S. PATENT DOCUMENTS

| | | | |
|---|---|---|---|
| 2,037,210 | 4/1936 | Buente | 72/239 |
| 3,208,260 | 9/1965 | Sieger et al. | 72/239 |

*Primary Examiner*—Milton S. Mehr

*Attorney, Agent, or Firm*—Lee & Smith

[57] ABSTRACT

For inserting and removing packers into and from a rolling mill stand having roll adjusting hydraulic piston and cylinder assemblies in the top of each stand housing, a packer-carrying sledge runs on tracks extending into the stand below the lowermost rolls of the stand. The sledge is located in the stand during rolling and can carry packers which are located operatively between the chocks of the lowermost roll and the housings.

4 Claims, 3 Drawing Figures

ROLLING MILL STAND

Figure 1:
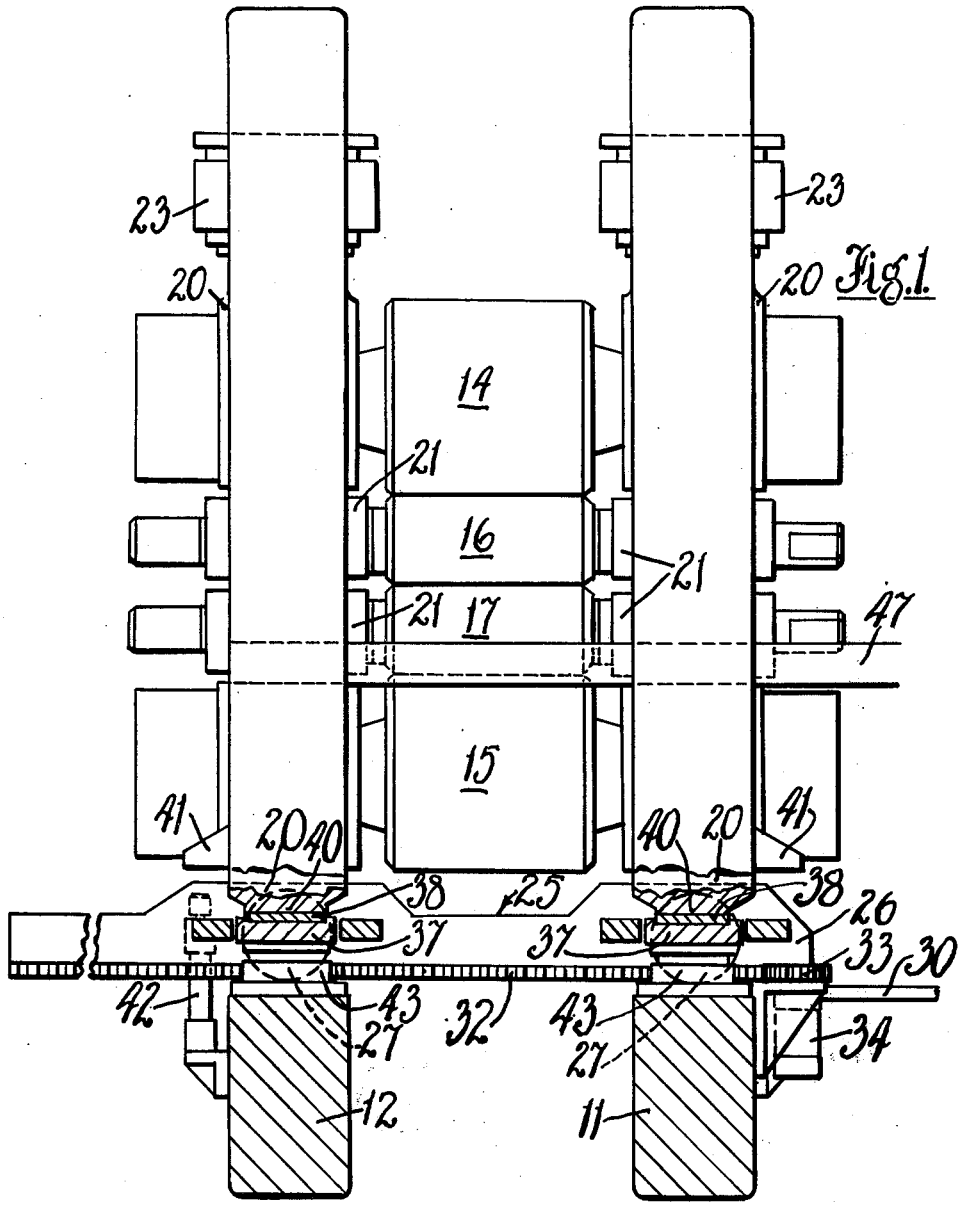

This invention relates to a rolling mill stand and, particularly, to a rolling mill stand for rolling material such as metal, the stand having a pair of spaced housings, each having therein a window to receive the chocks of the rolls, or some of those chocks. The invention is primarily concerned with a 4-high mill stand having a pair of work rolls and a pair of back-up rolls, but it is applicable to other stands, and particularly to a 2-high stand.

The invention particularly relates to a rolling mill stand in which each housing has roll gap adjustment means to act between the top of the housing and the uppermost roll. The roll gap adjustment means are preferably piston and cylinder assemblies, but they may be mechanical screwdowns.

In a rolling mill stand of the type having hydraulic piston and cylinder assemblies in the housings for adjusting the roll gap, it is usual to have those assemblies in the bottoms of the housing windows, acting upwardly on the roll stack. That arrangement has certain practical difficulties, which are removed by the location of the assemblies in the tops of the housings, acting between the housings and the uppermost roll of the roll stack.

When the piston and cylinder assemblies are located in the bottoms of the windows, there is little difficulty in placing packers at the tops of the windows, in order to maintain a substantially constant pass-line regardless of roll wear. However, when the assemblies are located in the tops of the housings, packers cannot be easily replaced because the weight of the stack acts on them and because the bottoms of the windows are less accessible than the tops.

In order to facilitate packer interchange, in a rolling mill stand comprising a pair of spaced housings having windows therein to receive bearing chocks of rolling mill rolls, and roll gap adjustment means carried by each housing to act between the top of the housing and the uppermost roll, the present invention provides sledge means movable between an inoperative position outside the housings and an operative position at the bottom of the windows, the sledge means being in the operative position during rolling; means on the sledge means for carrying packers to be disposed operatively between the bottom of each window and the lowermost roll; and means for lifting the rolls sufficiently to permit movement of the sledge means between the operative and inoperative position. When it is desired to change packers, the sledge means can be removed to the position outside the housings, the packers interchanged, and the sledge means returned to the stand.

The sledge means may comprise a separate sledge for each housing, but in that case it is advantageous to have them connected so as to move together between the operative and inoperative positions; both sledges can then be withdrawn to the operator's side of the mill and it becomes unnecessary for the operator to reach the relatively inaccessible drive side in order to change the packer at that side. It is however preferred to have a single sledge on which packers for both housings are carried and which can be withdrawn to the operator's side; the packers on the drive side of the mill stand can then be interchanged again at the operator's side of the stand, at the same time as the packers at the operator's side, and packer interchange is facilitated and expedited.

Preferably, the sledge is in the form of a carriage and the packer carrying means are trays for the housings adapted to receive packers. The trays are preferably removable from the carriage, and may be mounted on upwardly acting resilient means.

The sledge may be employed to remove the rolls from the housings. Further, the sledge facilitates removal of the work rolls of a 4-high mill stand, in that the withdrawal of the removable trays enables the lower back-up roll to be lowered to allow the work rolls to be supported on roll-change tracks.

The invention includes methods of operating the rolling mill stand for replacing the packers, replacing the work rolls, or replacing all the rolls, with or without the piston and cylinder assemblies, when provided for roll gap adjustment.

Figure 3:
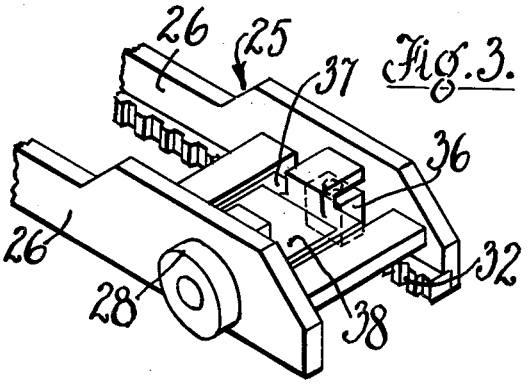
Figure 2:
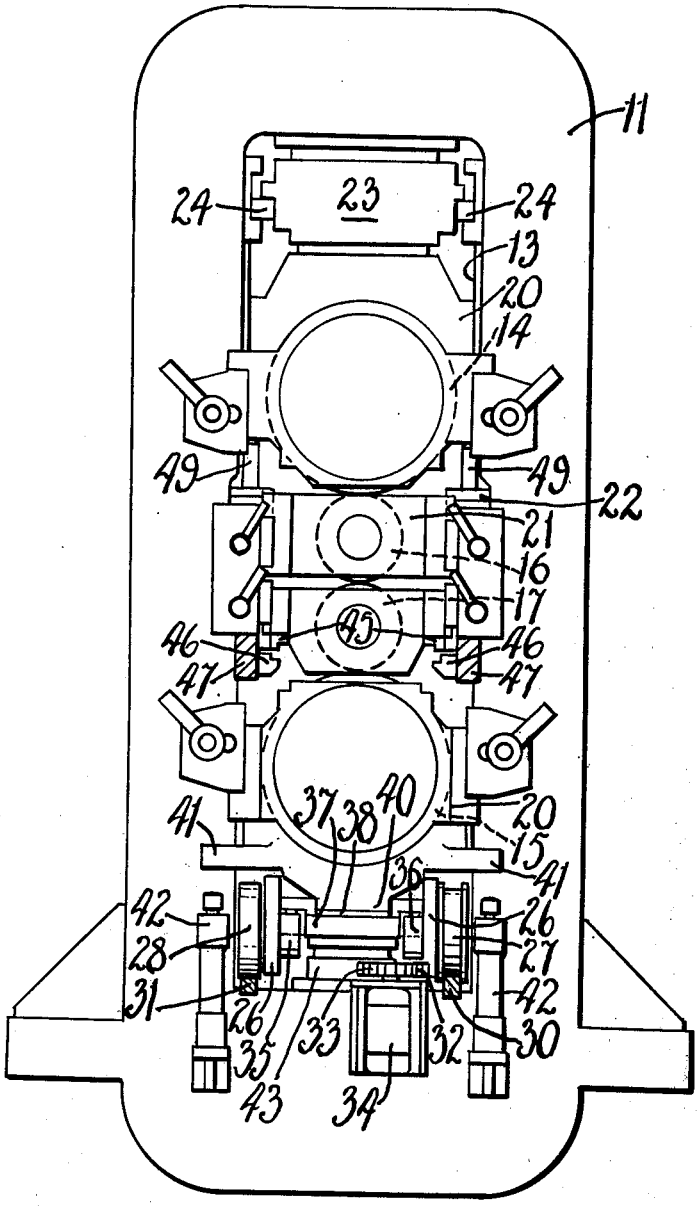

The invention will be more readily understood by way of example from the following description of a rolling mill stand in accordance therewith, reference being made to the accompanying drawings, in which:

FIG. 1 is a vertical section of the mill stand, taken on the line I—I of FIG. 2, FIG. 2 is a section on line II—II of FIG. 1, and FIG. 3 is a perspective view of part of the sledge means.

The metal rolling mill stand shown in the drawings comprises a pair of spaced housings 11, 12, each having a vertical window 13. The roll stack of the stand as shown comprises upper and lower back-up rolls, 14, 15 and upper and lower work rolls 16, 17. The necks of each of the back-up rolls 14, 15 are journalled in chocks 20, which are slidably received in the housing windows 13. Similarly, the work rolls 16, 17 have chocks 21 which are guided by blocks 22 secured to the housings.

A piston and cylinder assembly 23 is located in the top of each window 13, so as to act between the tops of the housings and the chocks 20 of the upper back-up roll 14. Each piston and cylinder assembly 23 is held in place by keepers 24 detachably secured to the housings.

At the bottom of the housings 11, 12, there is sledge means in the form of a carriage 25, which consists of a pair of vertical side plates 26, which are equally spaced from the centre line of the mill stand and which are tied together, and two pairs of wheels 27, 28. The wheels 27 on one side of the carriage means are flanged and run on a rail 30, while the other pair of wheels 28 are unflanged and run on a parallel rail 31; rails 30, 31 are mounted on the housings and extend between them. A rack 32 is formed on the inner face of the plate 26 adjacent the wheels 27, and meshes with a pinion 33 of a hydraulic motor 34. By actuation of the motor 34, the carriage can be driven parallel to the axes of the rolls between an operative position within the housings and between the bottoms of the windows and the chocks 20 of the lower back-up roll 15, and an inoperative position outside the housings.

The carriage 25 further carries, for each housing 11, 12, a pair of resilient means 35, 36, in the form of upwardly-biased spring plungers. The resilient means 35, 36 for each housing supports the wings of a tray 37 for that housing, the tray extending between the resilient means and located between the plates 26. Each tray is arranged to receive one or more packers, an example of which is indicated at 38.

Each chock 20 of the lower back-up roll 15 is formed with a downwardly directed tongue 40 which can be received within the tray 37, as shown in FIG. 2, and has also oppositely directed wings 41, extending beyond the rails 30, 31. Beneath the extremities of the wings 41 are located a pair of piston and cylinder assemblies 41, which on actuation can engage the wings 41 and lift the stack of rolls off the packer 38 and tray 37.

During rolling, the sledge is in the operative position as shown in the drawings. When the piston and cylinder assemblies 23 are operated, the stack of rolls are 7 forced downwardly, overcoming the bias of the springs of the resilient means 35, 36 and causing the trays 37 to engage against the upper surfaces of load cells 43 seated on the bottom of the housing window. The rolling load thus passes, in each housing, directly from the chock 20 of the lower backup roll 15, and through the packer 38, the tray 37 and the load cell 43, to the bottom of the housing; little, if any, of the rolling load is transmitted through the carriage 25 and the rails 30, 31 to the housing.

If it is desired to change packers (38), to compensate for roll wear, the cylinders of the assemblies 23 are exhausted and the assemblies 42 are actuated to lift the roll stack, so that the tongues 48 are lifted clear of the packers 38. The resilient means 35, 36 then operate to raise the trays 37 off the load cells 43. Hydraulic motor 34 is actuated to traverse the carriage out of the stand, that movement of the carriage being effected without damage to the surfaces of the load cells 43, as the trays 37 are no longer in contact with them. The packers 38 can then be replaced as required, outside the stand, and then returned to their operative positions, by reversing the sequence of operation just described.

For work roll change, the cylinders of assemblies 23 are exhausted and the assemblies 42 are actuated, as before. The carriage 25 is traversed out of the stand and the trays 37 removed and the carriage returned to the stand. The upper roll 14 is retained in its elevated position by means of hydraulic rams 49 in the blocks 22, and then the assemblies 42 are exhausted so that the wings 41 become seated on, and supported by, the side plates 26. During the downward movement of the work rolls and lower back-up roll, wings 45 extending outwardly from the chocks 21 of the lower work roll 17 engage lugs 46 on rails 47, which are carried by the housings, which extend between those housings, and which are movable lengthwise. When the work rolls are supported by the lugs 46 and the lower back-up roll is supported by the plates 26, the lower work roll 17 is out of contact with the lower back-up roll 15, and the work rolls can be removed from the mill by moving the rails 47, with the work rolls carried on the lugs 46. The new work rolls are replaced in a similar fashion, fresh packers, appropriate to the diameters of the new work rolls, being located on the trays 37 before the latter are returned to the stand.

To remove all the rolls from the stand, the stack is raised by the assemblies 42, the carriage 25 traversed out of the stand, the trays 37 removed, and the carriage returned to the stand as previously described. The rails 47 are removed, and the assemblies 42 exhausted so that the stack is lowered until it is supported by the side plates 26 of the carriage. The hydraulic motor 34 is finally actuated to drive the carriage with the superposed stack, out of the stand. The new stack is inserted in the stand by the same procedure in reverse order. Before the trays 37 are returned to the housings, packers appropriate to the new rolls are inserted.

If desired, the hydraulic piston and cylinder assemblies 23 can be removed from the housings, with the roll stack. For that purpose, the latches 24 are first removed, so that the assemblies 23 are seated on the chocks 20 of the upper back-up roll 14, and can be removed together with those chocks.

What I claim as my invention and desire to secure by Letters Patent is:

1. In a rolling mill stand having (a) first and second spaced housings each having therein a window;

(b) a plurality of rolls;

(c) bearing chocks for each said roll, (d) the chocks of at least some of said rolls being slidingly received in said windows; and (e) roll gap adjustment means carried by each said housing to act between the top of said housing and the uppermost of said rolls;

equipment for inserting and removing packers into and from said stand, said equipment comprising (f) a carriage movable parallel to the axes of said rolls between an inoperative position outside said housings and an operative position at the bottom of each said window, (g) said carriage being in said operative position during rolling;

(h) a pair of trays for carrying packers to be disposed operatively between the bottom of each said window and the lowermost of said rolls;

(i) upwardly acting resilient means on said carriage for supporting each said tray, which resilient means are located in each window when said carriage is in operative position and lift each said tray away from the bottom of the associated window unless each said tray is forced down by said rolls into contact with the bottom of the associated window; and (j) means for lifting said rolls sufficiently to permit movement of said carriage between said operative and inoperative positions with said trays lifted by said resilient means.

2. Packer inserting and removing equipment as claimed in claim 1, further comprising a load cell in the bottom of at least one of said windows, one of said trays being disposed over said load cell when said carriage is in said operative position, said resilient means ensuring that, during rolling, a chock of said lowermost roll is supported by said load cell through said tray, and, during movement of said carriage, said tray is lifted out of contact with said load cell.

3. Packer inserting and removing equipment as claimed in claim 1, in said which trays are removable from said carriage, and said carriage has upwardly extending support members to engage the chocks of said lowermost roll when said trays have been removed.

4. In a rolling mill stand having (a) first and second spaced housings each having therein a window;

(b) a plurality of rolls;

(c) bearing chocks for each said roll;

(d) the chocks of at least some of said rolls being slidingly received in said windows; and (e) roll gap adjustment means carried by each said housing to act between the top of said housing and the uppermost of said rolls;

equipment for inserting and removing packers into and from said stand, said equipment comprising (f) a carriage movable parallel to the axes of said rolls between an inoperative position outside said housings and an operative position at the bottom of each said window, (g) said carriage being in said operative position during rolling;

(h) packer carrying means on said carriage including a pair of removable trays for carrying packers to be disposed operatively between the bottom of each said window and the lowermost of said rolls when said carriage is in operative position;

(i) upwardly extending support members on said carriage to engage the chocks of said lowermost roll when said trays are removed; and (j) means for lifting said rolls sufficiently to permit movement of said carriage between said operative and inoperative positions.

* * * * *